US007445059B1

(12) United States Patent
Falgout, Sr.

(10) Patent No.: US 7,445,059 B1
(45) Date of Patent: Nov. 4, 2008

(54) DRILL STRING DEFLECTING APPARATUS

(76) Inventor: Thomas E. Falgout, Sr., 110 Charles Read St., Lafayette, LA (US) 70503

( * ) Notice: Subject to any disclaimer, the term of this patent is extended or adjusted under 35 U.S.C. 154(b) by 0 days.

(21) Appl. No.: 12/072,865

(22) Filed: Feb. 27, 2008

Related U.S. Application Data

(63) Continuation of application No. 11/030,637, filed on Jan. 5, 2005, now abandoned.

(51) Int. Cl.
*E21B 7/08* (2006.01)

(52) U.S. Cl. ..... 175/74; 175/101

(58) Field of Classification Search ..... 175/74, 175/61, 101
See application file for complete search history.

(56) References Cited

U.S. PATENT DOCUMENTS 4,655,299 A 4/1987 Schoeffler
4,811,798 A 3/1989 Falgout
5,297,641 A 3/1994 Falgout
5,495,900 A 3/1996 Falgout
5,673,764 A 10/1997 Falgout
5,775,444 A 7/1998 Falgout
6,364,034 B1 4/2002 Schoeffler

*Primary Examiner*—Jennifer H Gay
*Assistant Examiner*—Robert E Fuller
(74) *Attorney, Agent, or Firm*—John D. Jeter

(57) ABSTRACT

Manipulation of the rate of drilling fluid flow down a drill string containing the apparatus causes a drilling fluid powered linear motor, preferably a piston, to move an output shaft, hingedly attached to the general body to laterally, and selectively, deflect the longitudinal axis of the apparatus with the effect of bending an associated drill string assembly just above the drill head.

12 Claims, 3 Drawing Sheets

180 DEG.

DRILL STRING DEFLECTING APPARATUS

This invention relates to a drill string serial component used to deflect the drill string for directional control of a progressing well bore during drilling activity. Deflection is actuated by drilling fluid flow down the drill string bore.

BACKGROUND OF INVENTION

During the drilling of a well bore it is often necessary to deflect the drill string, near the drill head, to drill a directional well. On occasions, it is necessary to deflect the drill string to prevent an unwanted influence from urging the progressing bore out of the planned path.

When drilling motors are used near the drill head, or bit, a bent sub can be used to urge the bit to move laterally from the existing well bore. In the past, the bent sub often had to be added to the drill string to influence the well bore direction. Then it had to be removed to progress without the lateral influence. The drill string had to be tripped to change the bent sub.

To eliminate the need for tripping the drill string, many forms of bendable subs have been devised to enable the bending and straightening operation without removing the drill string from the well. Such subs have been beneficial in many cases but often caused problems.

Drilling motors are usually used below the bending apparatus. In very soft formations, jets may be used below the bending apparatus to deflect the progressing well bore.

When used without drilling motors, and in conjunction with selective stabilizer placements, enlargement of some length of well bore has been achieved.

SUMMARY OF INVENTION

In a body serving as a drill string element, a piston powered by the drilling fluid moves to act upon a hinged output shaft to cause it to rotate about a transverse axis to deflect the output shaft from the body centerline. The body is part of the upper drill string, which is generally aligned with the existing well bore. The deflected output shaft is, therefore, deflected relative to the existing well bore. When the flow of drilling fluid is stopped the piston is moved to the original position by a spring, and the deflected output shaft is again aligned with the body centerline.

The piston is again urged to move when drilling fluid flow is resumed. The piston travel is controlled by a stroke limiter arrangement that is driven by a cam actuated by movement of the piston. The stroke limiter, called a walk-around, has provisions to allow the piston to move only a short distance on alternate excursions of the piston. The short distance does not cause deflection. To change the distance the piston moves, the fluid flow is reduced and again increased. The deflection, then, is actuated on alternate fluid flow initiations.

To eliminate the likelihood of confusion concerning which mode is operative down hole a flow restrictor is actuated when the piston makes the longer excursion to actuate the deflection assembly. Some piston movement is needed to rotate the walk around but the piston is allowed some movement before the deflector is actuated. The short piston excursion does not actuate the deflector assembly or flow restrictor.

These and other objects, advantages, and features of this invention will be apparent to those skilled in the art from a consideration of this specification, including the attached claims and appended drawings.

BRIEF DESCRIPTION OF DRAWINGS

FIG. 1 shows the upper end of the embodiment of the invention.

FIG. 2 shows the central portion of the embodiment of the invention.

FIG. 3 shows the lower end of the embodiment of the invention.

FIG. 4 shows the upper end of the embodiment in the deflection mode.

FIG. 5 shows the central portion of the embodiment in the deflection mode.

FIG. 6 shows the lower end of the embodiment, form the aspect of FIG. 3 but in the deflected configuration.

FIG. 7 shows a lower portion of the embodiment with the pivot axis of the output shaft in the plane of the drawing, with some components omitted to show the far side of the enclosure.

FIG. 8 shows the same area as FIG. 7 rotated ninety degrees and cut to show deflection cam mechanisms, and omitting some components to illustrate cam components.

DETAILED DESCRIPTION OF DRAWINGS

In the formal drawings, some features common to machine construction and having no bearing upon the points of novelty are omitted in the interest of descriptive clarity. Such omissions relate to the connection features common to ball-and-socket connections, sealing details, and locking features for threaded connections, and the like.

Figure 3:
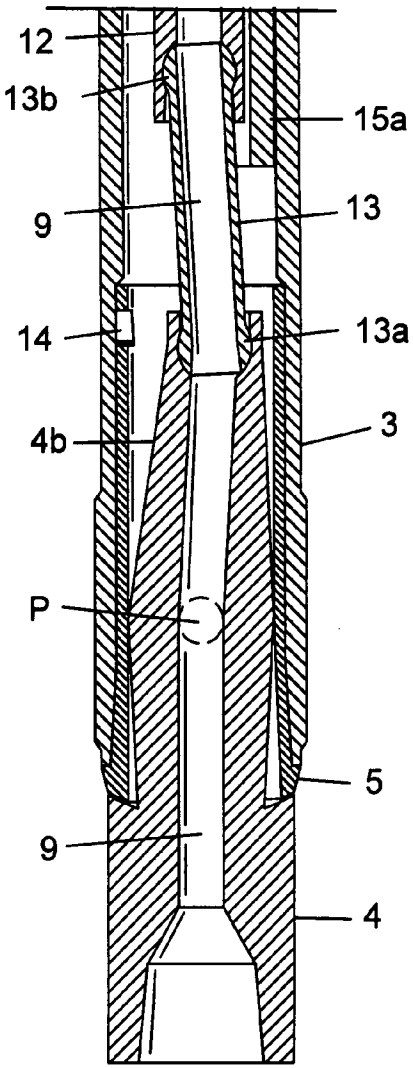
FIGS. 1-8 are side views, cut away along the general center line of the assembly. The embodiment is a series of FIGS. 1-3 and Figs
Figure 2:
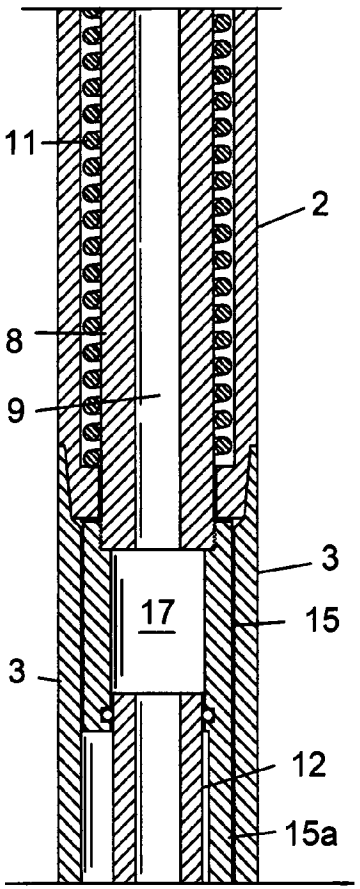
Figure 1:
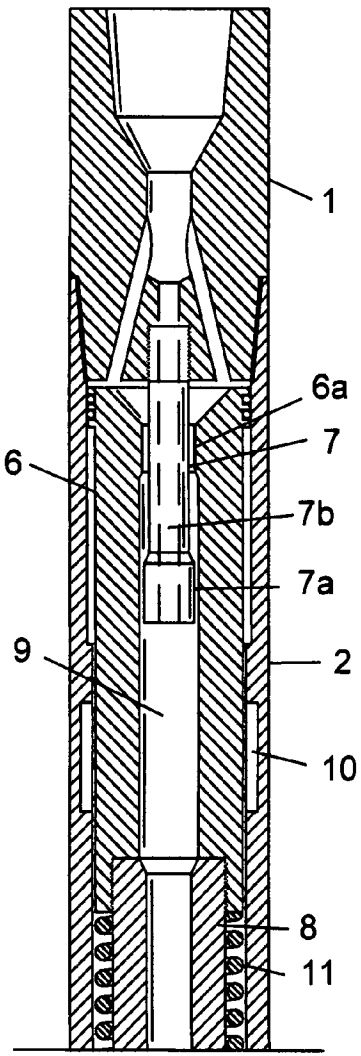

In FIGS. 1-3, upper terminal 1, upper body housing 2, lower body housing 3 and output shaft 4 comprise a serial element of a drill string. In FIG. 1, upper terminal 1 has an upper tool joint feature which may be a box as shown or a tool joint pin if appropriate for connection to a drill string. Drilling fluid conduits deliver drilling fluid from the upwardly continuing drill string bore to the top of piston 6. Fluid channel 9 continues through the tool to deliver drilling fluid from any upwardly continuing drill string to and through the output shaft 4 for delivery to any downwardly continuing drill string when attached. Piston 6 is shown in the upward position, urged there by spring 11. Throttle arbor 7 is suspended from the upper terminal 1 and is situated in flow bore 9 to provide flow resistance to provide pressure, if needed, to actuate the piston in response to drilling fluid flow down flow bore 9. All pressure drop between the piston top and the well bore is available to move the piston. The throttle arbor has enlargement **7*a* to cooperate with flow channel restriction 6*a*** to increase the fluid flow resistance when the piston moves downward. The flow restriction provides increased piston thrust when the tool is deflected, and it provides a pressure increase detectable at the surface to indicate that the tool is in the deflected mode.

The stroke selector turret 10 is bearingly supported in upper body housing 2 to rotate to regulate the piston stroke excursion distance on alternate drilling fluid flow initiations. The turret 10 is a common "walk around" feature detailed in FIGS. 9 and 10. The walk around feature is well established in the art. In common use, the walk around allows long piston strokes on odd onsets of drilling fluid flow and allows only short strokes on even onsets of drilling fluid flow. The action of restriction change by arbor 7 and restriction 6*a* indicate the deflection mode active at any time. By-pass 7*b* can be sized to allow flow adaption latitude for the planned drilling fluid flow rate. The by-pass influences the pressure change caused by the throttle arbor 7.

Figures 7, 8, 9, 10, 11, 12:
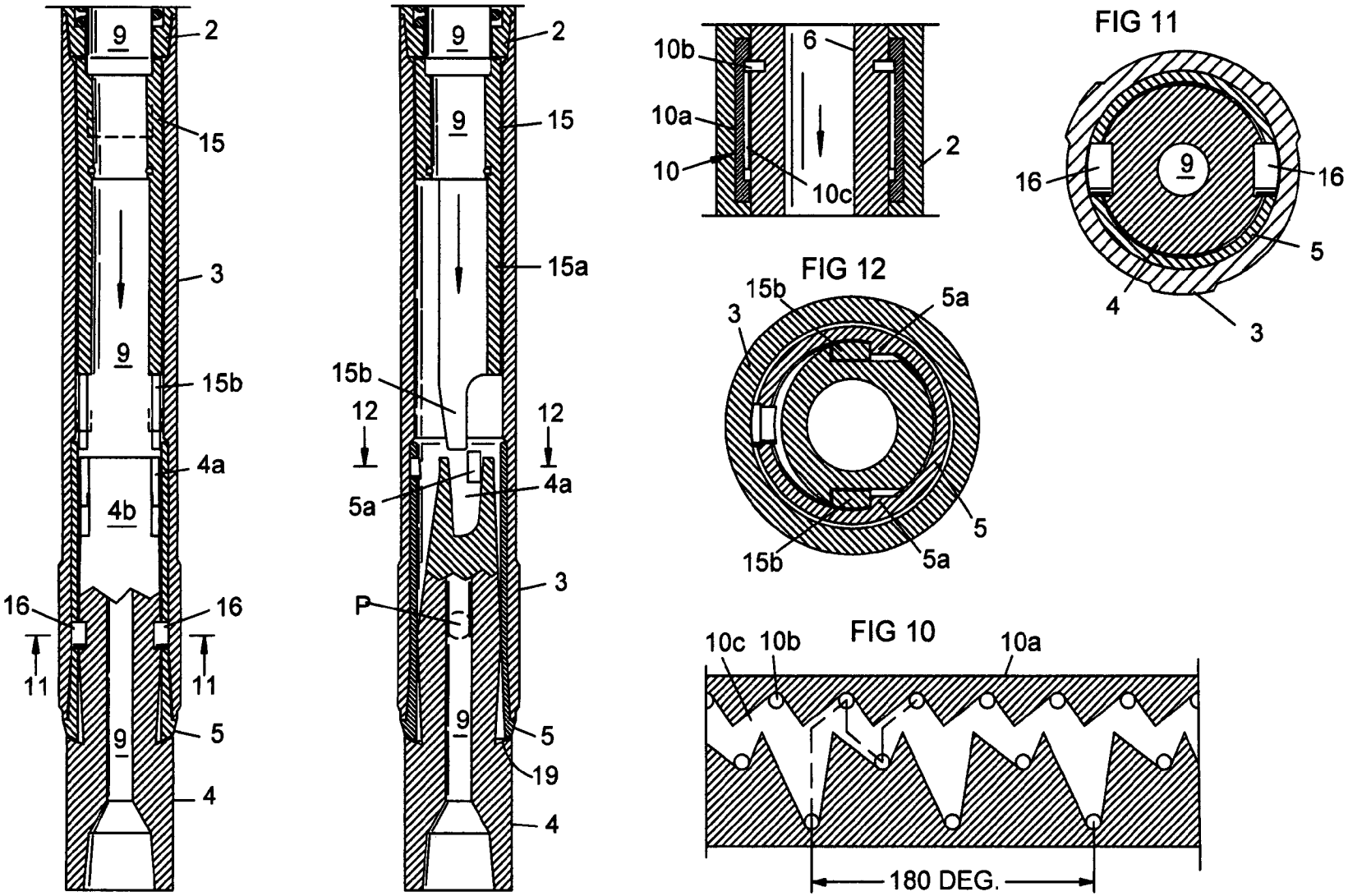
FIG. 9 is a side view, cut along the center line and rather enlarged, to show the piston stroke control arrangement.
FIG. 10 is a development of the stroke control turret sleeve inner surface, viewed from the axis, showing the serpentine groove that is common to such "walk-around" apparatus.
FIG. 11 is a sectional view taken along line 11-11.
FIG. 12 is a section taken along line 12-12.

Piston extension 8 transmits piston action to piston deflection actuator 15 to act on the output shaft, by processes shown by FIGS. 7-8. Flow conductor 12 telescopes into the bore 17 when the piston moves downward. Flexible link 13 is connected by ball joints 13*a* and 13*b* to flow conductor 12 and to the output shaft 4. Flow bore 9 is sealed relative to the tool general enclosure. A cam carrier 15*a*, cams not shown, extends cams from the piston deflection actuator 15 to engage cams on the output shaft (see FIGS. 7 and 8). The general enclosure is not sealed relative to ambient fluid pressure in the well bore surrounding the tool, when in use down hole.

Transition sleeve 5 is threadedly attached at the lower end to the lower body housing 3. The transition sleeve carries the pivot axles 16, shown in FIG. 7, which allow the output shaft to rotate about a transverse axis at point P. The deflection is usually limited to about five degrees. The amount of deflection is limited by the deflection control insert 14 supported in the transition sleeve 5. The transition sleeve eliminates the need to support pivot axles in the wall of lower body housing 3.

Figure 6:
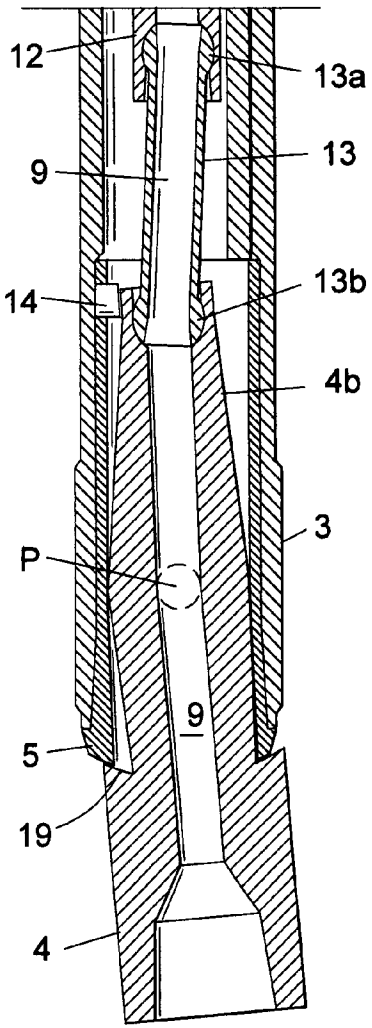
Figure 5:
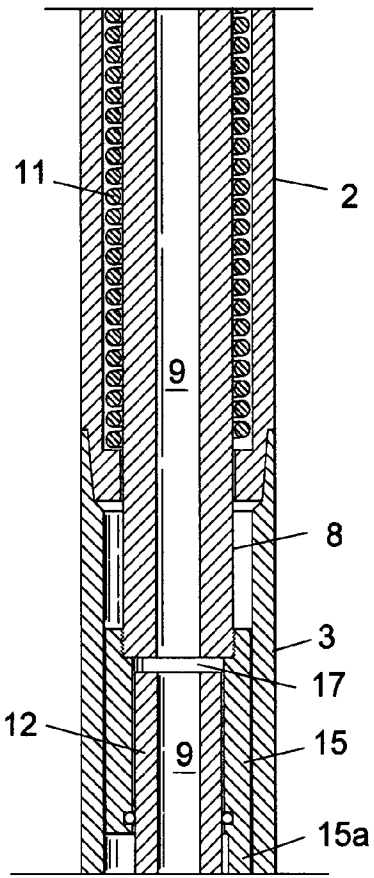
Figure 4:
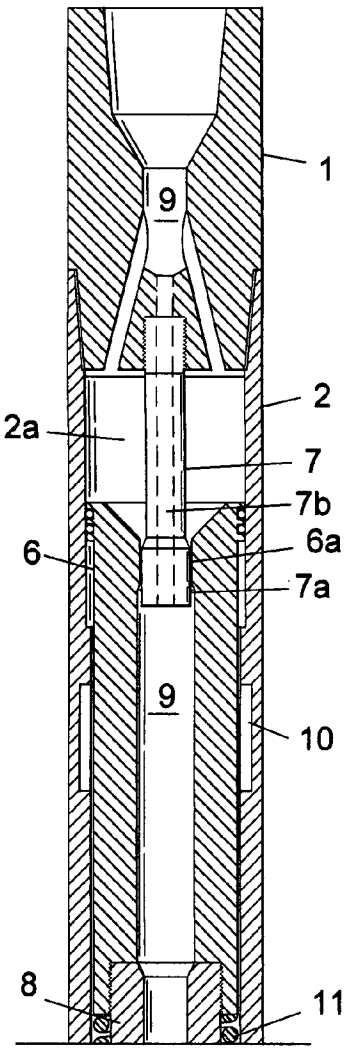

FIGS. 4-6 are identical to FIGS. 1-3 but in the deflected mode. Drilling fluid flow exists and piston 6 has moved downward. Throttle arbor enlargement 7*a* is in the restricted part 6*a* of flow bore 9. Fluid pressure on piston 6 has increased, adding thrust to the piston and causing a pressure increase detectable at the surface. Piston extension 8 and the deflection actuator has moved downward and cammed the output shaft upper extension 4*b* leftward, see FIGS. 7-8. Upper extension 4*b* is limited in deflection by engaging the deflector control insert 14. The output shaft is deflected from the tool general center line as shown. A drilling motor, not shown, is usually attached to the tool joint at the bottom of the output shaft 4. In softer formations, a jet arrangement may be attached to the output shaft rather than a drilling motor, with similar effect on the direction of the progressing well bore.

The stroke selector 10 has been in position to allow the actuating stroke of the piston. When the drilling fluid flow is stopped, or greatly reduced, spring 11 pushes the piston back to the starting position, upward as shown in FIGS. 1-3. The upward movement rotates the stroke selector to the short stroke position and the next onset of drilling fluid flow will move the piston downward only a short distance, not enough to again actuate the deflecting mechanism.

FIGS. 7 and 8 show the same general length shown by FIG. 3. The pivot axis of the output shaft lies in the plane of FIG. 7. FIG. 8 is the same as FIG. 7 but is rotated ninety degrees about the tool longitudinal axis. The pivot axles 16 are short cylinders located in close fitting holes in transition sleeve 5, and extend into cooperating recesses in the output shaft 4. The upper extension 4*b* of the output shaft has cam surface cut out 4*a* to engage the cams 15*b* extending from the cam actuator 15. The cams are situated to allow some downward movement before engaging the cam surfaces 4*a* so that the piston can move downward enough to rotate the stroke selector 10, but not cause deflection of the output shaft 4. On alternate downward excursions of the piston, the stroke selector allows the piston and cams to move downward, as shown by dashed lines on FIG. 7, and causes the output shaft to deflect as shown by FIG. 6. When the piston is allowed to recover to the upward position the output shaft is allowed to straighten, as shown by FIG. 3, when the drill string is rotated. The output shaft has an upwardly facing spherical surface 19 engaged by the lower end of transition sleeve 5. When the drill string applies bit load to urge the output shaft upward, the spherical surface adds stability to the output shaft and seals the interior from large particles common the well bore fluids.

FIGS. 8 and 12 show cam stabilizing features 5*a* on the inner surface of the transition sleeve 5. The cam 15*b* tends to be laterally displaced by forces applied when deflecting the output shaft. Projections 5*a* engage, and stabilize, cam 15*b* as it moves downward under piston forces.

FIG. 9 shows the stroke selector 10, cut away along the centerline. The turret 10*a* is free to rotate in the upper body housing 2. Pins 10*b*, in the piston wall, engage grooves 10*c* to rotate the turret. Groove 10*c* is serpentine to provide cam walls configured to convert vertical movement of the pins to rotary movement of the turret.

FIG. 10 shows the configuration of the groove 10*c*. A pin 10*b* is shown in every position that a pin will occupy, at some time, when the position of the pin has reached the vertical travel limit during a series of piston excursions. The present design has only two pins diametrically opposite on piston 6. The dashed lines show a typical cycle of travel of one pin. These concepts of walk-arounds are in common use in down hole tools and serve the same purpose. The pin, or pins, may be carried by the sleeve to engage serpentine grooves cut in the outer surface of the linearly moving member, piston 6 in this case. There can be any number of pins and the groove may have any number of short stroke permitting features between long stroke permitting features. The ratios can also be reversed.

FIG. 11 is a sectional view cut through the pivot point P. Axles 16 are short modified cylinders and are carried by transition sleeve 5. Close fitting recesses in the output shaft 4 allow the axles to rotate therein.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, I claim:

1. A drill string deflection apparatus for use as a serial length member of a drill string for actuation between a straight and a bent configuration in response to manipulation of drilling fluid flow rate down the drill string, the apparatus comprising:

a) an elongated housing, with a longitudinal axis, for attachment to an upwardly continuing drill string, with a generally cylindrical central opening to accept a piston;

b) said piston sealingly situated in said opening to provide force in response to drilling fluid pressure;

c) a transition sleeve, threadably attached to said elongated housing to support a transverse axle;

d) an output shaft hingedly supported on said axle for lateral deflection from said longitudinal axis, said output shaft having an upwardly extending portion, and a downwardly extending portion to extend from said body for attachment to a downwardly extending drill string;

e) cooperating cams on said upwardly extending portion and said piston to rotate said output shaft about said axle when said piston moves from an upward position to a preselected amount;

f) a spring situated in said generally central opening to urge said piston in a direction opposite the direction the piston is urged by drilling fluid pressure;

g) a drilling fluid flow channel extending through the longitudinal limits of said body and said output shaft to conduct drilling fluid from said upwardly extending drill string to said downwardly extending drill string; and h) said transverse axle supported by said transition sleeve.

2. The apparatus of claim 1 wherein said excursions comprise movement from a first position when drilling fluid pressure acting on the piston exceeds a first preselected amount and return to said first position when said drilling fluid pressure is reduced to said first preselected amount.

3. The apparatus of claim 1 wherein said axle comprises two independent lengths.

4. The apparatus of claim 1 wherein a piston stroke limiter is situated in said housing, responsive to movement of said piston, to limit movement of said piston to enable said piston to move said preselected amount on some excursions of said piston and prevent movement said preselected amount during other excursions of said piston.

5. The apparatus of claim 1 wherein a flow restrictor is situated in said flow bore, responsive to movement of said piston, to increase the restriction of the flow of drilling fluid when said piston is moved a preselected amount in response to drilling fluid flow.

6. The apparatus of claim 1 wherein said output shaft and said transition sleeve have abutting spherical surfaces generated from an intersection of the apparatus center line and the extended axis of said axles.

7. A drill string deflection apparatus for use as a serial length member of a drill string for actuation between a straight and a bent configuration in response to manipulation of drilling fluid flow rate down the drill string, the apparatus comprising:

a) an elongated housing, with a longitudinal axis, for attachment to an upwardly continuing drill string, with a generally cylindrical central opening;

b) a drilling fluid powered linear motor situated in said opening to provide movement of an output member in response to drilling fluid pressure;

c) a transition sleeve, threadably attached to said elongated housing to support a transverse axle;

d) an output shaft hingedly supported on said axle for lateral deflection from said longitudinal axis, said output shaft having an upwardly extending portion, and a downwardly extending portion to extend from said body for attachment to a downwardly extending drill string;

e) cooperating cams on said upwardly extending portion and said drilling fluid powered linear motor output member to rotate said output shaft about said axle when said output member moves from said first position a preselected amount;

f) a spring situated in said generally central opening to urge said drilling fluid powered linear motor output member toward said first position;

g) a drilling fluid flow channel extending through the longitudinal limits of said body and said output shaft to conduct drilling fluid from said upwardly extending drill string to said downwardly extending drill string; and h) said transverse axle supported by said transition sleeve.

8. The apparatus of claim 7 wherein said output member moves from said first position when drilling fluid flow exceeds a preselected amount and returns to said first preselected position when said drilling fluid flow is reduced to said preselected amount.

9. The apparatus of claim 7 wherein said axle comprises two independent lengths.

10. The apparatus of claim 7 wherein a stroke limiter is situated in said housing, responsive to movement of said output member, to limit movement of said output member to enable it to move said preselected amount on some excursions of said output member and prevent movement of said preselected amount during other excursions of said output member.

11. The apparatus of claim 7 wherein a flow restrictor is situated in said flow bore, responsive to movement of said piston, to increase the restriction of the flow of drilling fluid when said piston is moved a preselected amount in response to drilling fluid flow.

12. The apparatus of claim 7 wherein said output shaft and said transition sleeve have abutting spherical surfaces generated from an intersection of the apparatus center line and the extended axis of said axles.

* * * * *